US008283615B1

(12) United States Patent
Albertson

(10) Patent No.: US 8,283,615 B1
(45) Date of Patent: Oct. 9, 2012

(54) PERMANENT MAGNET AIR HEATER

(75) Inventor: Robert V. Albertson, Alma, WI (US)

(73) Assignee: Powermag, LLC, Chicago, IL (US)

( * ) Notice: Subject to any disclaimer, the term of this patent is extended or adjusted under 35 U.S.C. 154(b) by 367 days.

(21) Appl. No.: 12/658,398

(22) Filed: Feb. 12, 2010

Related U.S. Application Data

(60) Provisional application No. 61/217,784, filed on Jun. 5, 2009.

(51) Int. Cl.
*H05B 6/22* (2006.01)

(52) U.S. Cl. ..... 219/654; 219/628; 219/631

(58) Field of Classification Search ..... 219/628, 219/629, 630, 631, 654, 672
See application file for complete search history.

(56) References Cited

U.S. PATENT DOCUMENTS 2,549,362 A 12/1945 Bessiere et al.
3,671,714 A 6/1972 Charms
5,012,060 A * 4/1991 Gerard et al. ..... 219/631
5,914,065 A * 6/1999 Alavi ..... 219/631
6,011,245 A * 1/2000 Bell ..... 219/631
6,297,484 B1 10/2001 Usui et al.

* cited by examiner

*Primary Examiner* — David Nhu
(74) *Attorney, Agent, or Firm* — Eric L. Sophir; SNR Denton US LLP

(57) ABSTRACT

A permanent magnet air heater has a housing with an internal chamber accommodating an electric motor rotating a fan to move air through the housing. A non-ferrous member having bores for cylindrical magnets and a steel member with a copper plate secured to the steel member are rotated relative to each other by the motor whereby the magnetic field between the magnets and copper plate generates heat which is transferred to air in the housing moving through the housing by the fan.

16 Claims, 15 Drawing Sheets

PERMANENT MAGNET AIR HEATER

CROSS REFERENCE TO RELATED APPLICATION

This application claims the priority of U.S. Provisional Application Ser. No. 61/217,784 filed Jun. 5, 2009.

FIELD OF THE INVENTION

The invention is in the field of space air heaters having permanent magnets that generate magnetic fields creating heat.

BACKGROUND OF THE INVENTION

Space heaters having electrical resistance coils to heat air moved with motor driven fans are in common use to dry objects and heat rooms. The heaters comprise housings surrounding electric motors and fans driven by the electric motors. Guide supporting electrical resistance elements located in the housings are connected to electric power sources to increase the temperature of the elements. The electrical resistance elements are very hot when subjected to electrical power. This heat is transmitted by conduction to air moved by the fans adjacent the electrical resistance elements. These heaters require substantial amounts of electric energy and can be electric and fire hazards. Magnetic fields of magnets have also been developed to generate heat. The magnets are moved relative to a ferrous metal member to establish a magnetic field which generates heat to heat air. Examples of heaters having magnets are disclosed in the following U.S. Patents.

Bessiere et al in U.S. Pat. No. 2,549,362 discloses a fan with rotating discs made of magnetic material fixed to a shaft. A plurality of electromagnets are fixed adjacent to the rotating discs. The eddy currents generated by the rotating discs produce heat which heats the air blown by the fan to transfer heat to a desired area.

Charms in U.S. Pat. No. 3,671,714 discloses a heater-blower including a rotating armature surrounded by a magnetic field formed in the armature by coils. The armature includes closed loops that during rotation of the armature generates heat through hysteresis losses. A motor in addition to generating heat also powers a fan to draw air across the heated coils and forces the air into a passage leading to a defroster outlet.

Gerard et al in U.S. Pat. No. 5,012,060 a permanent magnet thermal heat generator having a motor with a drive shaft coupled to a fan and copper absorber plate. The absorber plate is heated as it is rotated relative to permanent magnets. The fan sucks air through a passage into a heating chamber and out of the heating chamber to a desired location.

Bell in U.S. Pat. No. 6,011,245 discloses a permanent magnet heat generator for heating water in a tank. A motor powers a magnet rotor to rotate within a ferrous tube creating eddy currents that heats up the tube and working fluid in a container. A pump circulates the working fluid through the heating container into a heat transfer coil located in the tank.

Usui et al in U.S. Pat. No. 6,297,484 discloses a magnetic heater for heating a radiator fluid in an automobile. The heater has a rotor for rotating magnets adjacent an electrical conductor. A magnetic field is created across the small gap between the magnets and the conductor. Rotation of the magnets slip heat is generated and transferred by water circulating through a chamber.

SUMMARY OF THE INVENTION

The invention is an apparatus for heating air and discharging the heated air into an environment such as a room. The apparatus is an air heater having a housing surrounding an internal chamber. The housing has an air inlet opening and an air exit opening covered with screens to allow air to flow through the housing. A motor located in the chamber drives a fan to continuously move air through the chamber and discharge hot air from the chamber. The hot air is generated by magnetic fields established with permanent magnets and a ferrous metal member. A copper absorber plate mounted on the ferrous metal member between the magnets and ferrous metal member is heated by the magnetic fields. The heat is dissipated to the air in the chamber. The permanent magnets are cylindrical magnets located in cylindrical bores in a non-ferrous member, such as an aluminum member, to protect the magnets from corrosion, breaking, cracking and fissuring. The motor operates to rotate the ferrous member and copper member and non-ferrous member and magnets relative to each other to generate a magnet force field thereby heating air in the chamber. The heated air is moved through the chamber by the fan and discharged to the air exit opening to atmosphere.

DESCRIPTION OF THE INVENTION

Figure 1:
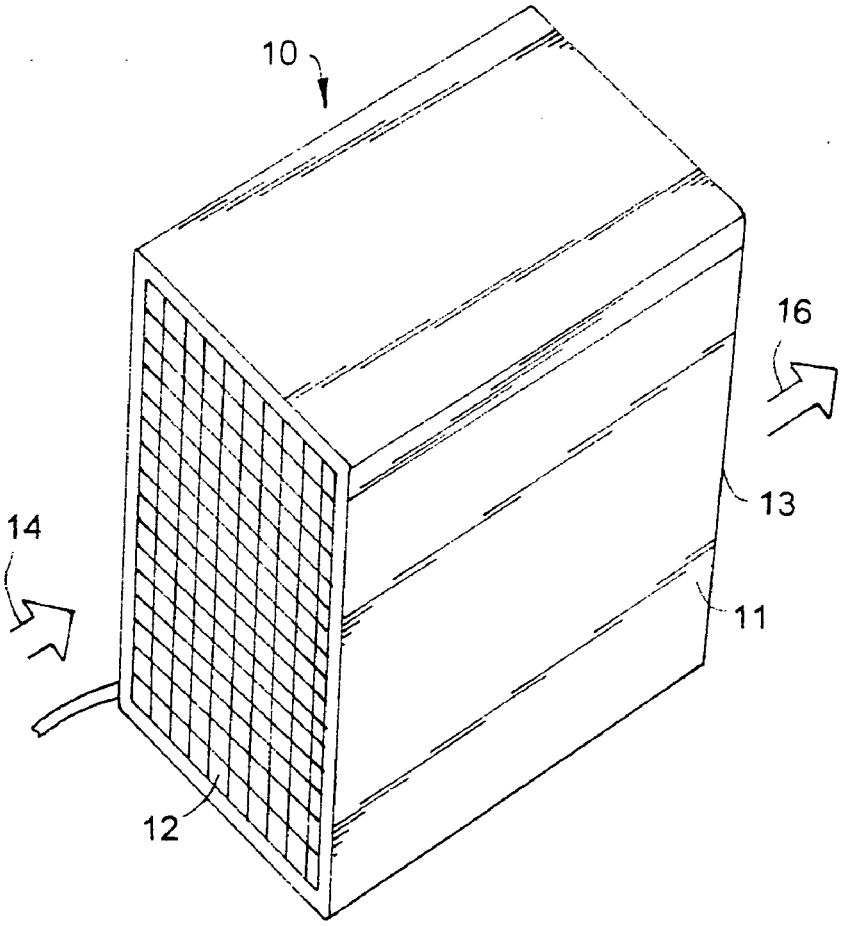
FIG. 1 is a perspective view of a first embodiment of the permanent magnet air heater of the invention.
Figure 2:
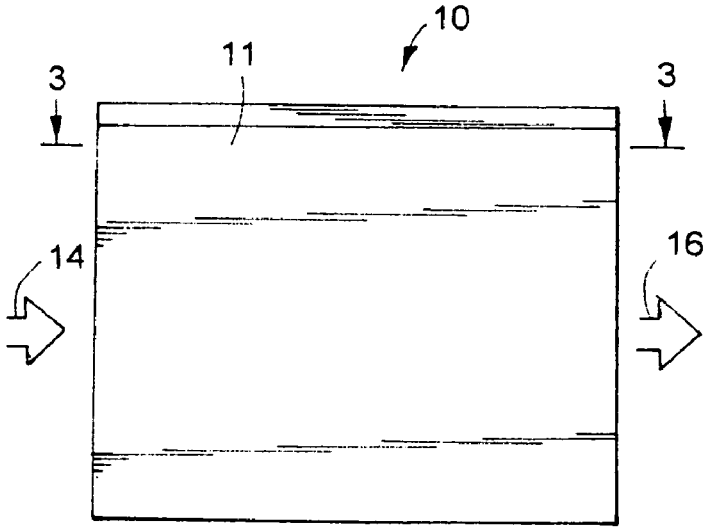
FIG. 2 is a side elevational view thereof.

A first embodiment of a magnet heat generator 10, shown in FIGS. 1 to 7, has a box-shaped housing 11 with open opposite ends to allow air to flow through mesh screens 12 and 13 shown by arrows 14 and 16. Screens 12 and 13 secured to opposite ends of housing 11 prevent access to the interior chamber 17 of housing 11. Screen 12 can include air filter media operable to collect dust, dirt, pollen and other airborne particulates.

Figure 5:
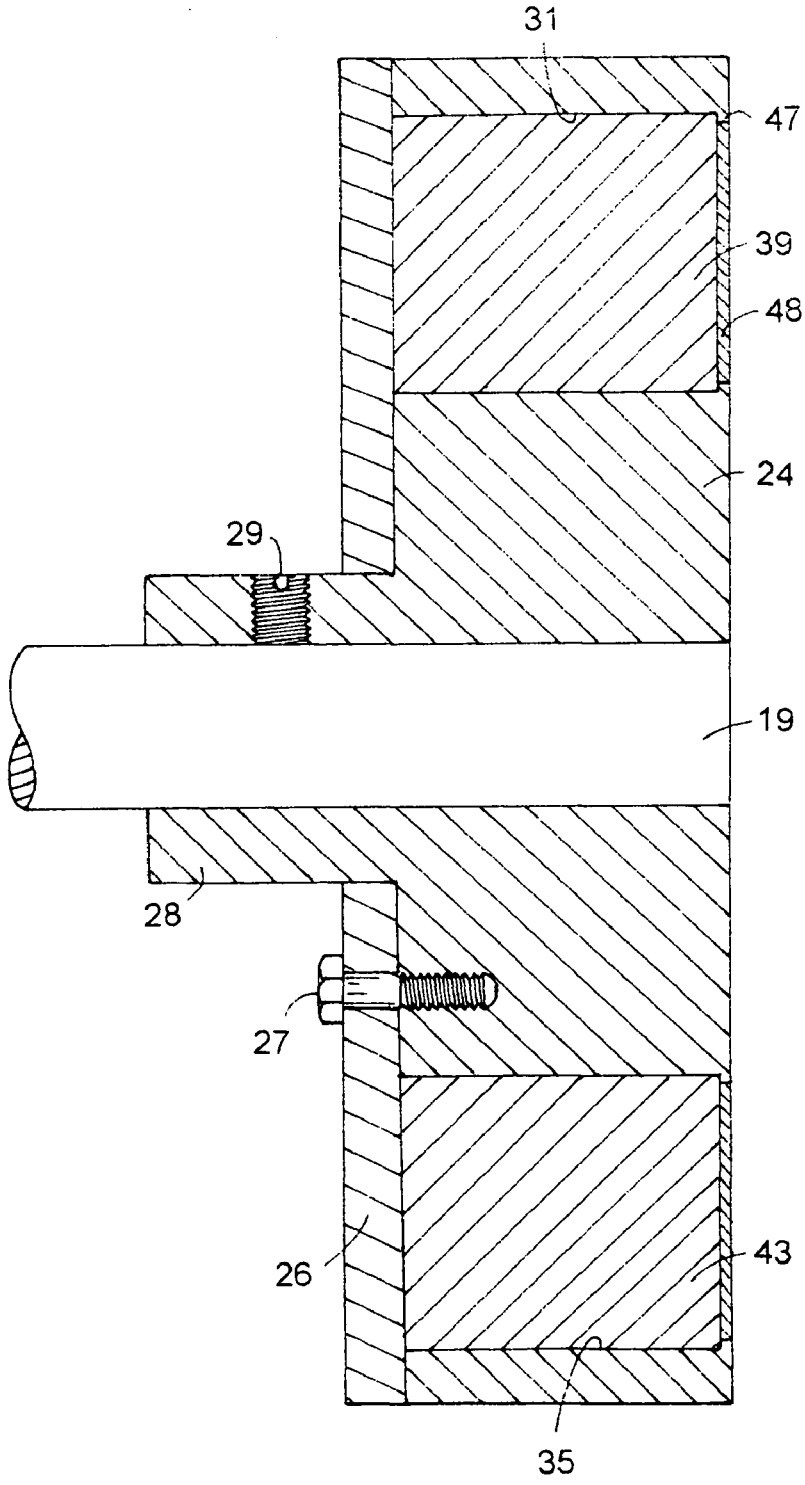
FIG. 5 is a sectional view taken along line 5-5 of FIG. 4.
Figure 6:
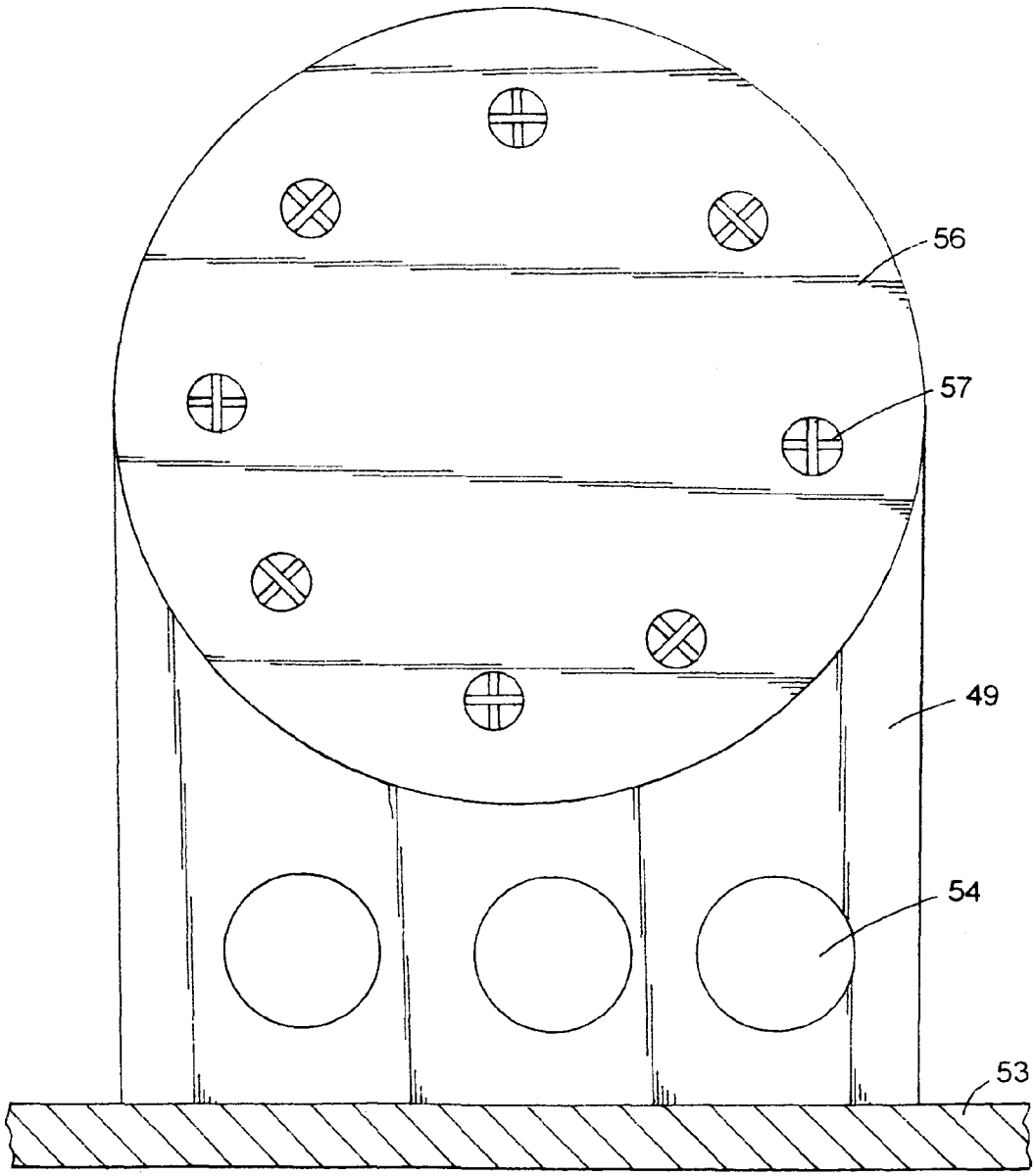
FIG. 6 is an enlarged sectional view taken along the line 6-6 of FIG. 3.

An electric motor 18 located in chamber 17 and mounted on housing 11 includes a drive shaft 19 coupled to an air moving device 21 shown as a disk with blades or fan to move air shown by arrows 22 through chamber 17. Motor 18 is a prime mover which includes air and hydraulic operated motors and internal combustion engines. Other types of fans can be mounted on drive shaft 19 to move air through chamber 17. A rotor 23 mounted on drive shaft 19 adjacent air moving device 21 supports a plurality of permanent magnets 39-46 having magnetic force fields used to generate heat which is transferred to the air moving through chamber 17 of housing 11. Rotor 23 comprises a non-ferrous or aluminum disk 24 and an annular non-ferrous plate 26 secured with fasteners 27, such as bolts, to the back side of disk 24. As shown in FIG. 5, disk 24 has a hub 28 with a bore accommodating drive shaft 19 of motor 18. A set screw 29 threaded in a bore in hub 28 secures hub 28 to shaft 19. Other types of connecting structures, such as keys or splines, can be used to secure hub 28 and disk 24 to shaft 19. Annular plate 26 can be an aluminum or ceramic plate.

Figure 4:
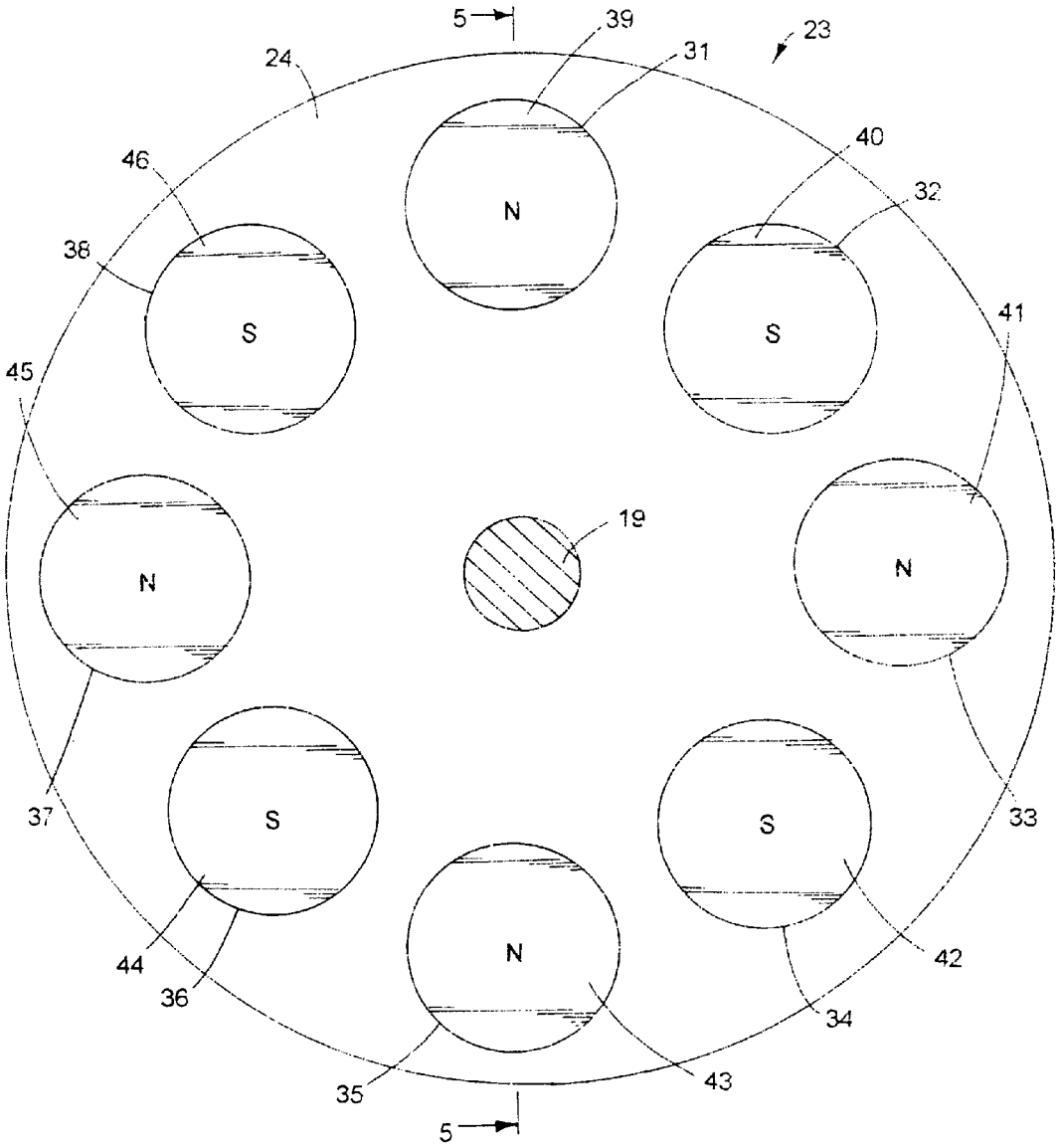
FIG. 4 is an enlarged sectional view taken along the line 4-4 of FIG. 3.

Returning to FIGS. 4 and 5, disk 24 has cylindrical bores 31-38 circumferentially spaced in a circular arrangement around the disk. The bores 31-38 are spaced radially inwardly adjacent the outer cylindrical surface of the disk. The bores 31-38 have uniform diameters and extended through disk 24. Permanent magnets 39-46 are cylindrical neodymium magnets having uniform outer cylindrical walls located in surface engagement with the inside cylindrical walls of bores 31-38. The edges of the cylindrical magnets are rounded to reduce chipping and breaking. An example of a neodymium cylindrical magnet is a Nd Fe B magnet having a 1-inch diameter, 1-inch length and a pull force of about 74 pounds. The magnets can be coated with nickel to inhibit corrosion and strengthen the magnet material. The magnets can also be coated with plastic or rubber to weatherproof the magnet material. Adjacent magnets have alternate or North South polaritus, shown by N and S in FIG. 4. As shown in FIG. 5, disk 24 has circular lips or flanges 47 at the outer ends of bores 31-38 that are stops to retain magnets 39-46 in the bores. Coatings 48, such as glass, plastic or rubber members, fill the spaces surrounded by lips 47. Magnets 39-46 are enclosed within bores 31-38 of disk 24. The annular plate 26 closes the rear ends of bores 31-38. the disk 24 and plate 26 protect the magnets 39-46 from corrosion, breaking, cracking and fissuring. Eight circumferentially spaced magnets 39-46 are shown in FIG. 4. The number, size and type of magnets mounted on disk 24 can vary. Also, an additional circular arrangement of magnets can be added to disk 24.

Figure 3:
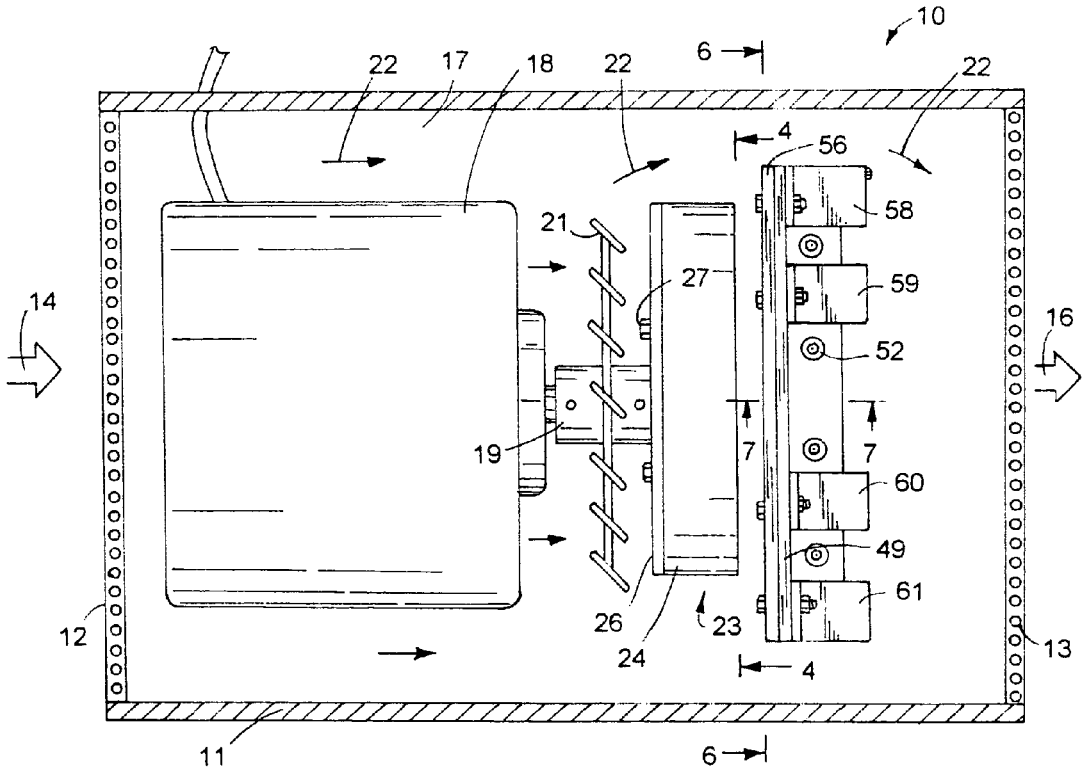
FIG. 3 is an enlarged sectional view taken along the line 3-3 of FIG. 2.
Figure 7:
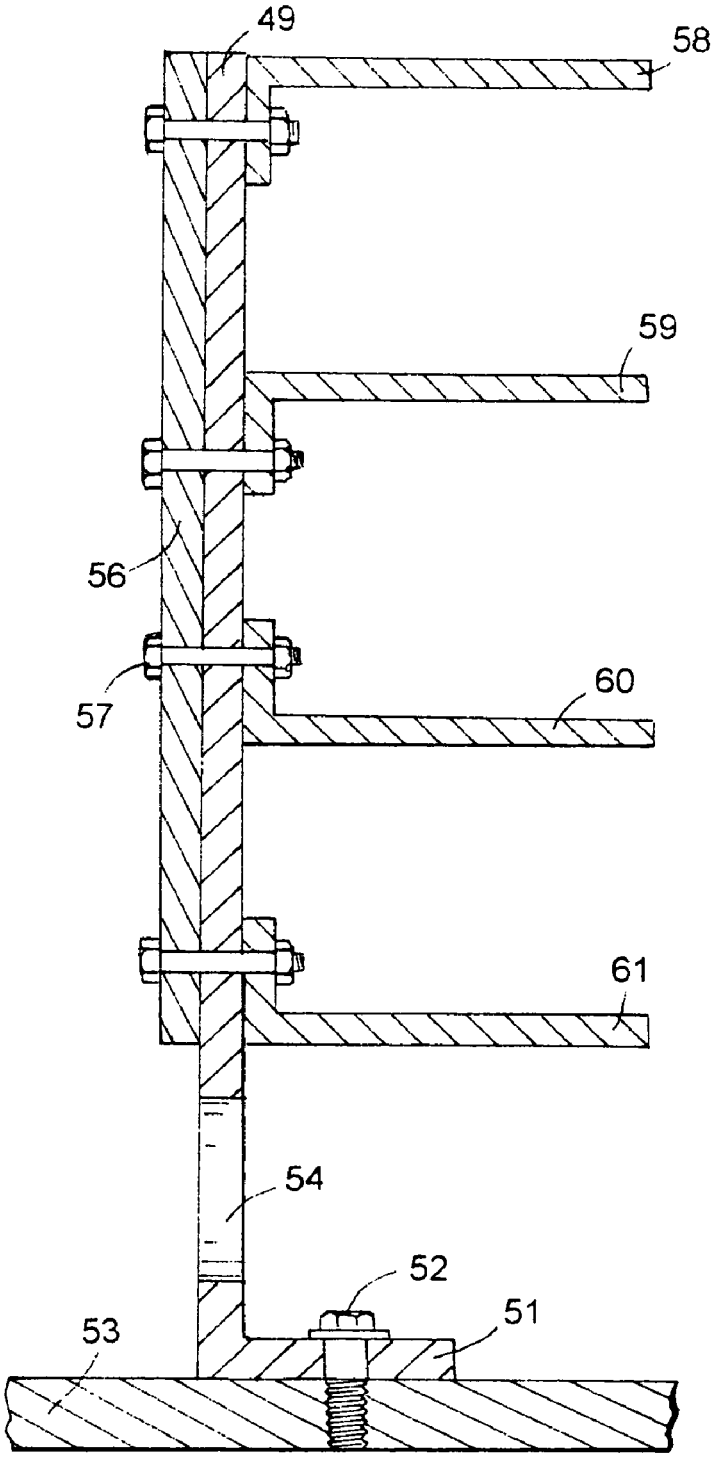
FIG. 7 is an enlarged sectional view taken along the line 7-7 of FIG. 3.
Figure 9:
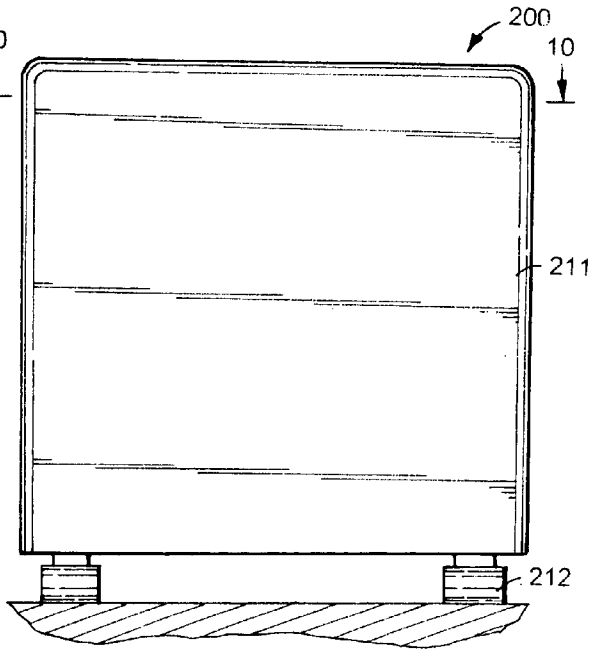
FIG. 9 is a side elevational view of FIG. 8.
Figure 8:
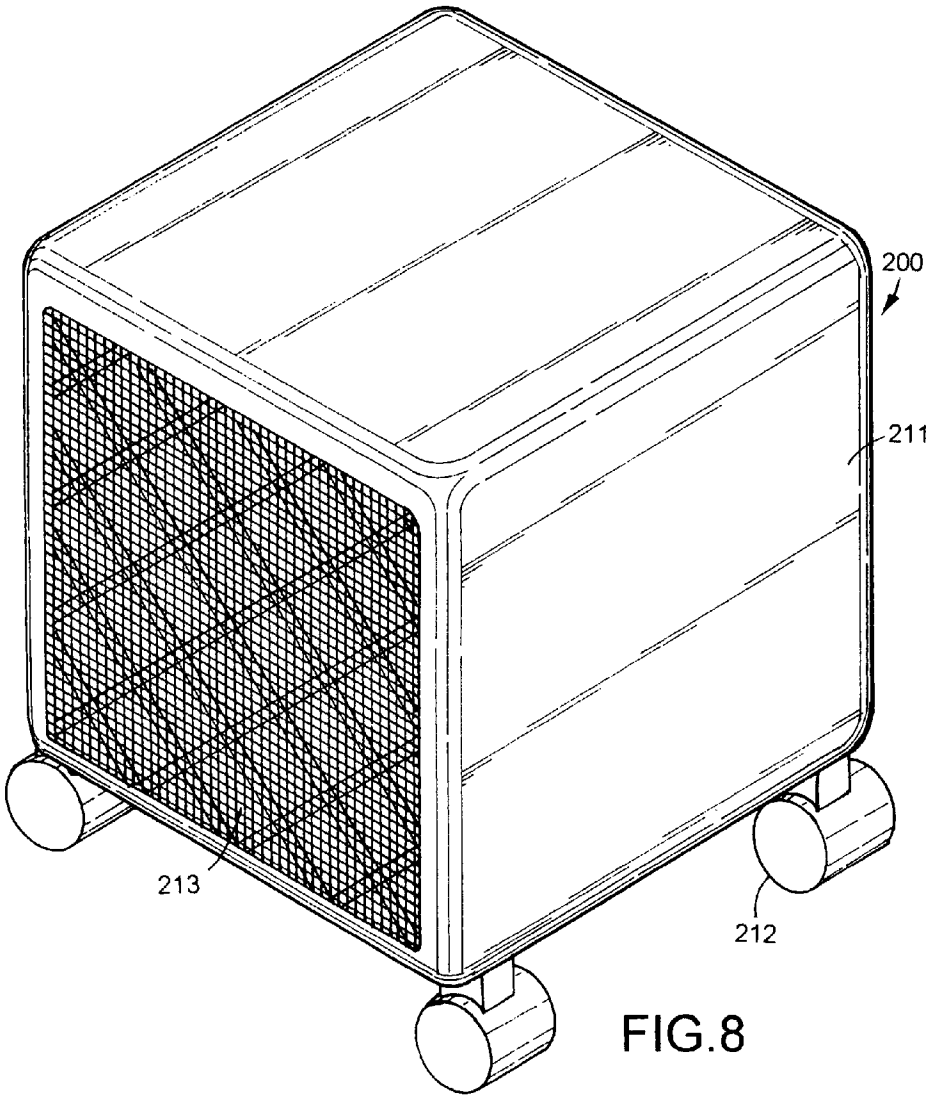
FIG. 8 is a perspective view of a second embodiment of the permanent magnet air heater of FIG. 1.
Figure 10:
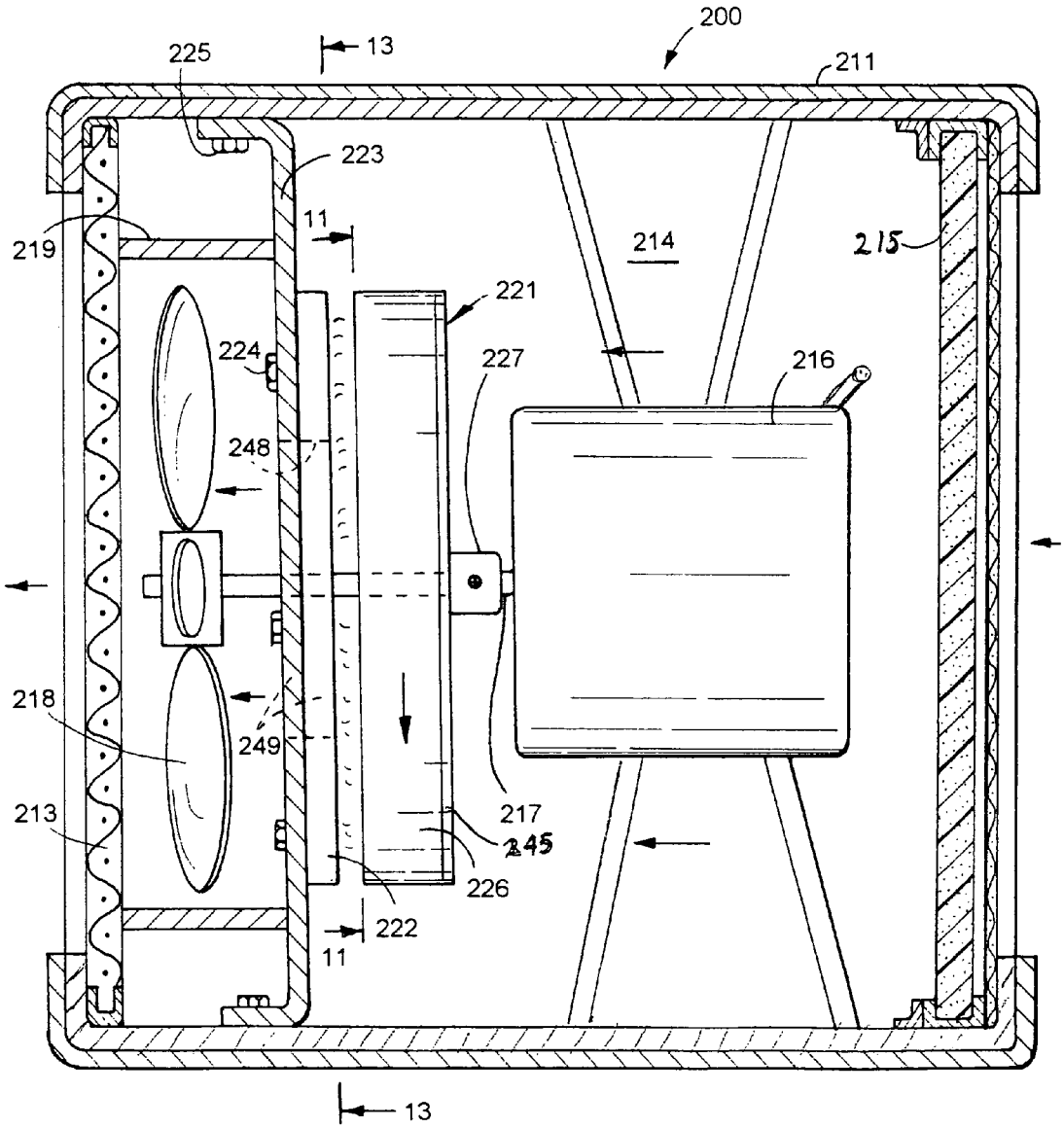
FIG. 10 is an enlarged sectional view taken along line 10-10 of FIG. 9.
Figure 11:
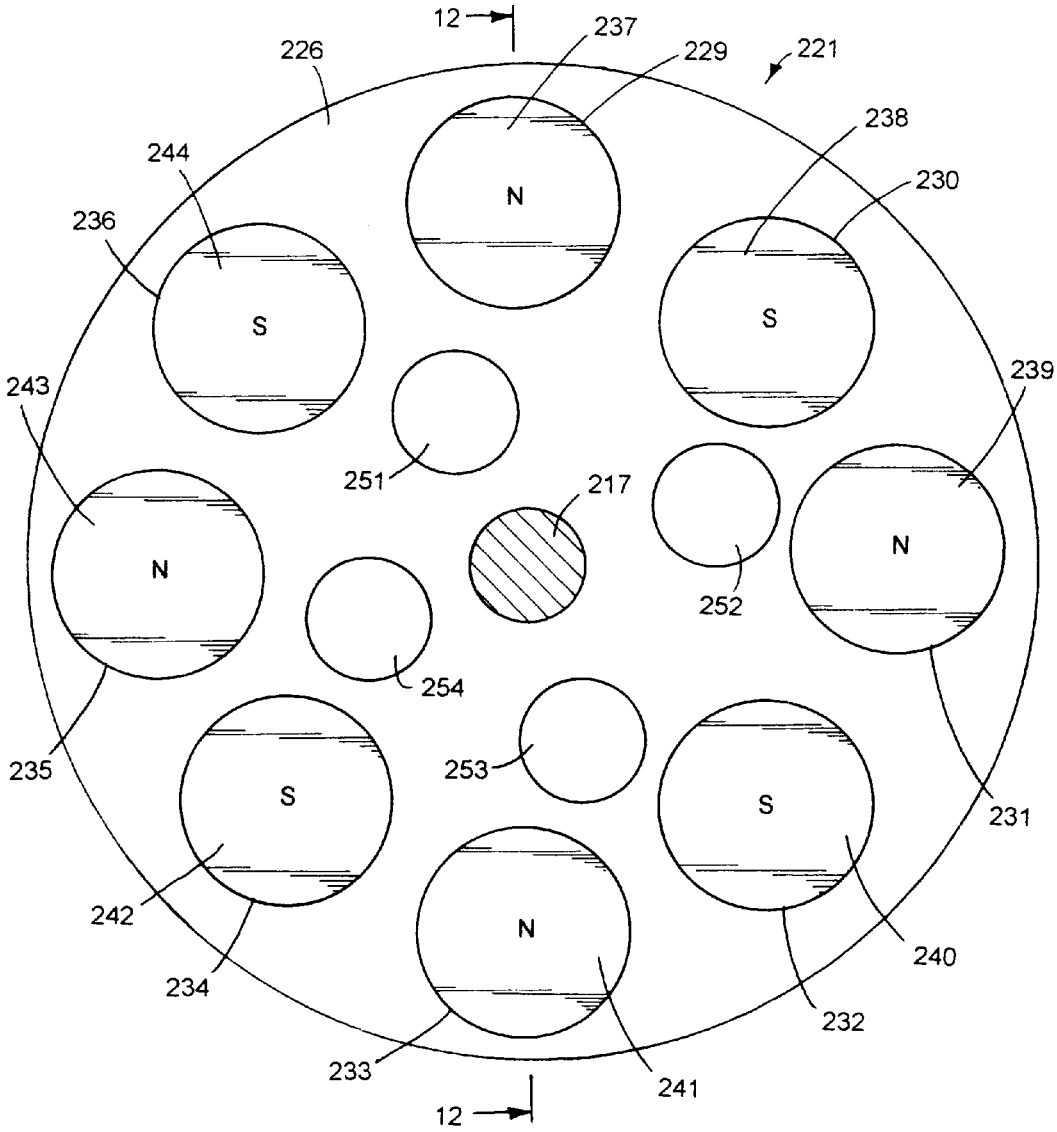
FIG. 11 is an enlarged sectional view taken along line 11-11 of FIG. 10.

Returning to FIG. 3, a steel plate 49 is secured with bolts 52 to base 53 of housing 11. Plate 49 extends upwardly into chamber 17 rearward of rotor 23. Plate 49 is a ferrous metal member. A copper absorber plate or disk 56 is attached with fasteners 57 to plate 49. Copper disk 56 has a back side in surface contact with the adjacent surface of plate 49. The front side of copper disk 56 is axially spaced from rotor 23. As shown in FIGS. 3 and 7, plurality of fins or tabs 58-61 attached to plate 49 conduct heat from plate 49 which is transferred to air moving in chamber 17. The air flowing around copper disk 56 and plate 49 is heated. The hot air continues to flow through holes 54 in plate 49 to the exit opening of housing 11.

In use, motor 18 rotates air moving device 21 and rotor 23. The magnets 39-46 are moved in a circular path adjacent cooper disk 56. The magnetic forces between magnets 39-46 and steel plate 49 generates heat which increases the temperature of copper disk 56. Some of the heat from copper disk 56 is conducted to steel plate 49 and fins 58-61 and other heat is transferred to the air around copper disk 56. The air surrounding motor 18 is also heated. The heated air is moved through chamber 17 and discharged to the environment adjacent exit screen 13, shown by arrow 16.

A second embodiment of the heat generator or heater 200, shown in FIGS. 8 to 13, has a box-shaped housing 211 supported on a surface with wheels 212. A screen 213 is located across the air exit opening of housing 211. An air filter 215 extends across the air entrance opening Of housing 211. The air flowing through housing interior chamber 214 is heated and dispensed as hot air into the environment around heat generator 200.

Figure 12:
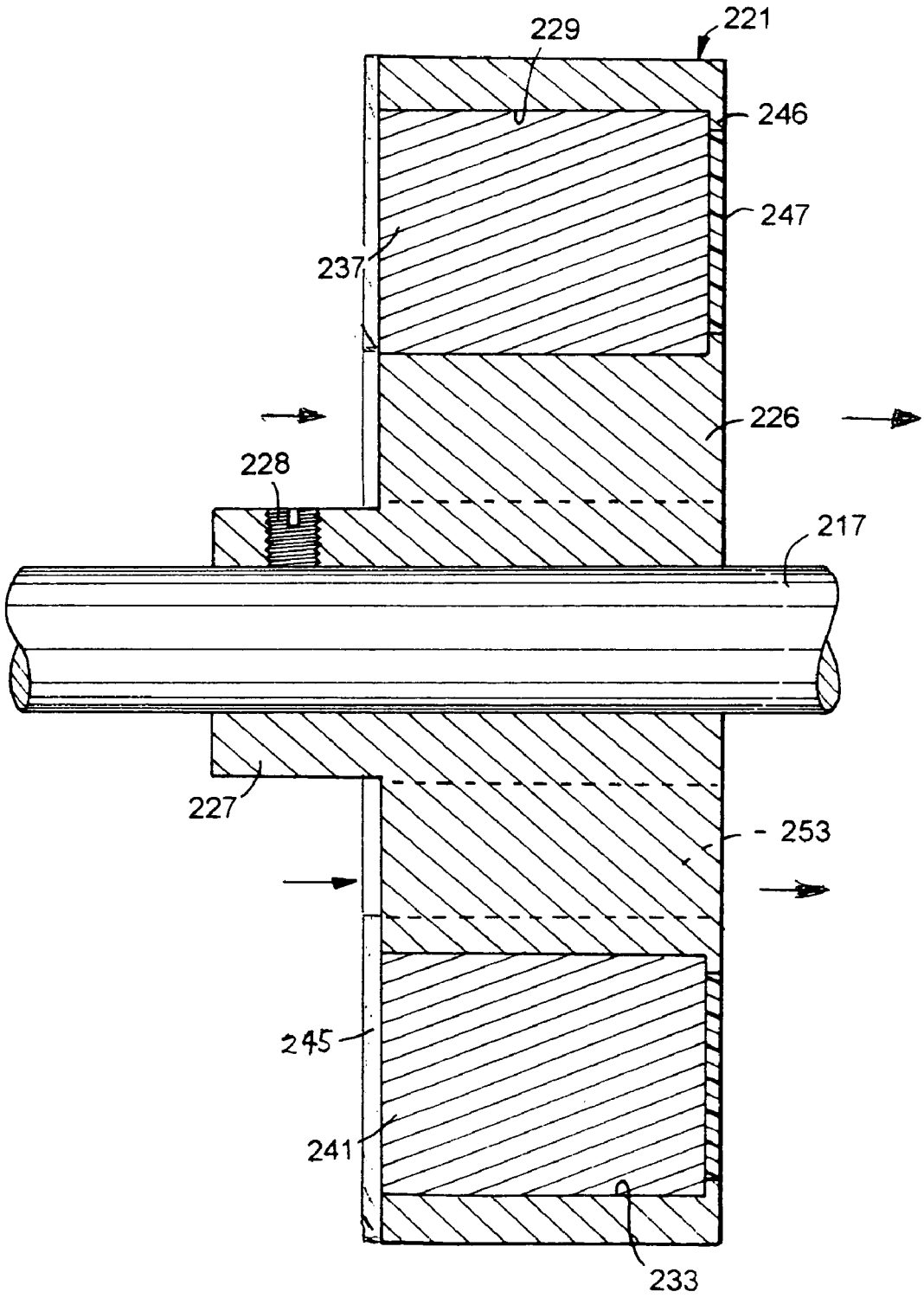
FIG. 12 is a sectional view taken along line 12-12 of FIG. 11.
Figure 13:
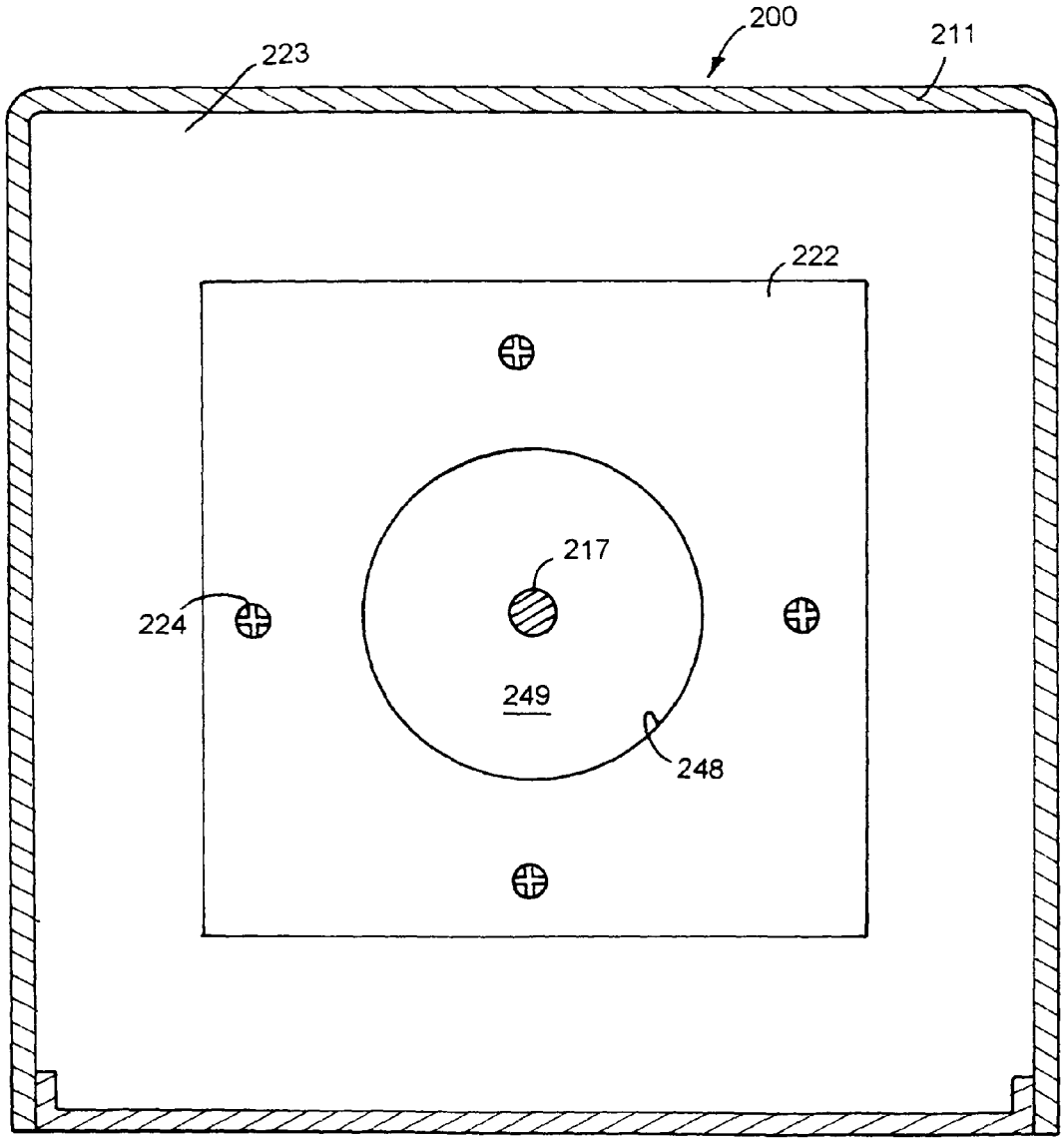
FIG. 13 is a sectional view taken along line 13-13 of FIG. 10.

An electric motor 216 mounted on the base of housing 211 has a drive shaft 217. A fan 218 mounted on the outer end of shaft 17 shaft 217 is rotated when motor 216 is operated to move air through chamber 214. A sleeve 219 surrounding fan 218 spaces the fan from screen 213. A rotor 221 mounted on drive shaft 217 is also rotated by motor 216. Motor 216 is a prime mover which includes but is not limited to electric motors, air motors, hydraulic operated motors and internal combustion engines. Rotor 221, shown in FIGS. 11 and 12, comprises non-ferrous or aluminum disk 226 having a hub 227. Hub 227 and disk 226 have a common axial bore accommodating motor drive shaft 217. A set screw 228 threaded into hub 227 secures hub 227 to shaft 217. A set screw 228 threaded into hub 227 secures hub 227 to shaft 217. Other devices, such as keys and splines, can be used to secure hub 227 and disk 226 to shaft 217. Disk 226 has a plurality of circumferentially arranged axial bores 229-236. Cylindrical permanent magnets 237-244 are located within bores 229-236. Adjacent magnets have N and S polarities. Disk 226, as seen in FIG. 12, has circular lips 246 at the outer ends of bores 229-236 that function as stops to retain magnets 237-244 in bores 229-236. Coatings 247, such as glass, plastic or rubber members, fill the spaces surrounded by lips 246. Coatings can also be applied to the inner ends of magnets 237-244. Also, a non-ferrous or aluminum plate 245 secured to disk 226 covers the inner ends of magnets 237-244. Magnets 237-244 located within disk 226 are protected from corrosion, breaking, cracking and fissuring. Magnets 237-244 are cylindrical neodymium permanent magnets having uniform outer cylindrical walls located in surface engagement with the inside cylindrical walls of bores 229-236. The number, size and types of magnets mounted on disk 226 can vary.

In use, motor 216 concurrently rotates rotor 226 and fan 218. Air is drawn through air filter 215 into chamber 214. The air cools motor 216 and flows in the gap or space between rotor 221 and copper disk 222 and through the opening 249 in copper disk 222 and steel plate 223 and out through screen 213 to the outside environment around heater 200. Copper disk 222 and steel plate 223 have cylindrical inside walls 248 located around opening 249. The eddy currents or magnetic force field in the space between rotor 221 and copper disk 222 generate heat that increases the temperature of copper disk 222 and steel plate 223. This heat is transferred to the air moving around copper plate 222 and steel plate 223. Fan 218 moves the hot air through screen 213 to the outside environment.

A third embodiment of the heat generator or heater 300, shown in FIGS. 14 to 17, has a box-shaped housing 310 removably mounted on a base 312. Housing 310 surrounds an interior chamber 311. A first screen 313 and air filter 314 extend across the air inlet opening to chamber 311. A second screen 316 extends across the air outlet opening of heater 300.

the air flowing through interior chamber 311 is heated and dispensed as hot air into the environment around heater 300.

Figure 14:
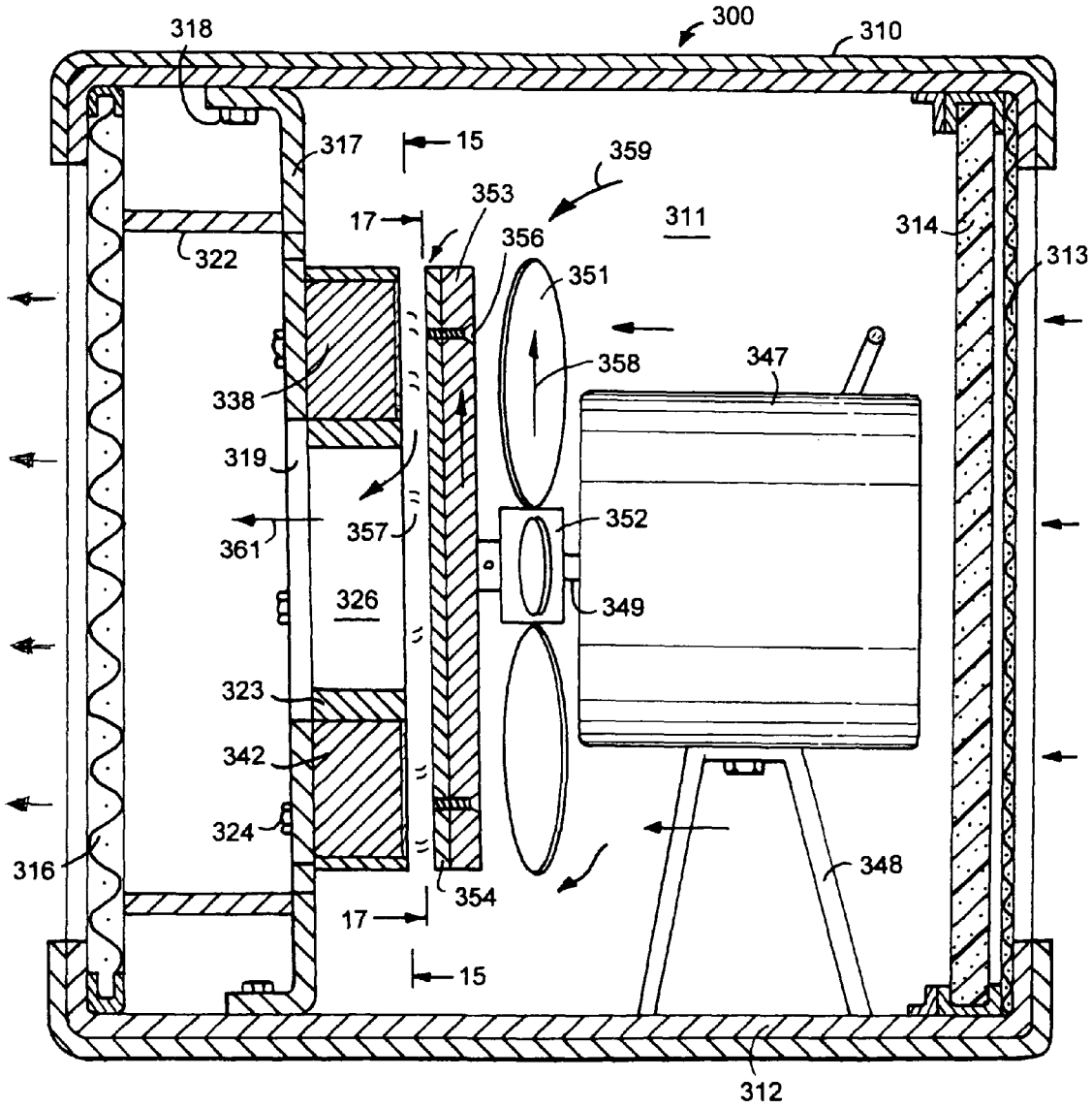
FIG. 14 is a sectional view similar to FIG. 10 of a third embodiment of the permanent magnet heater of FIG. 1.
Figure 15:
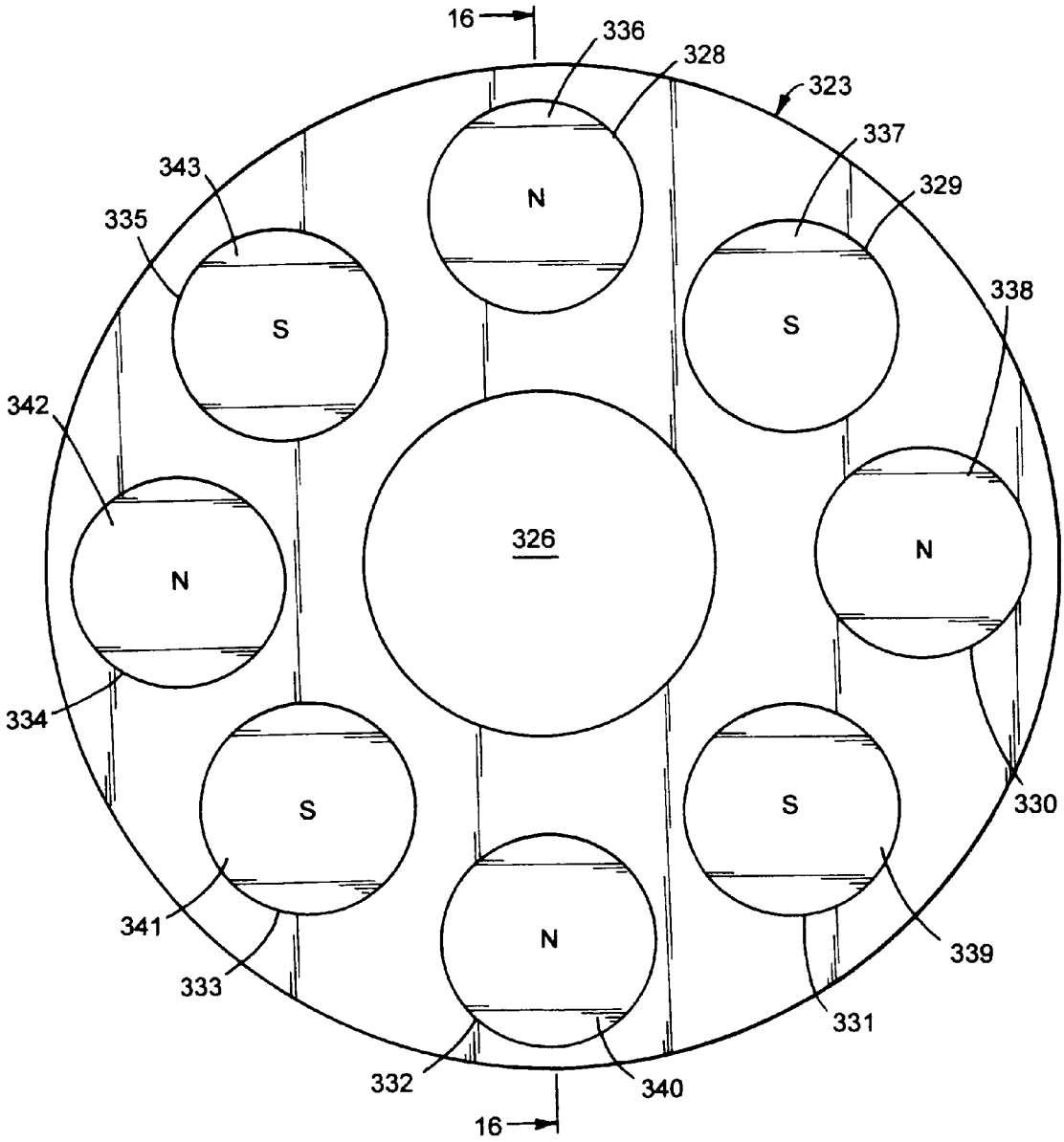
FIG. 15 is an enlarged sectional view taken along the line 15-15 of FIG. 14.
Figure 16:
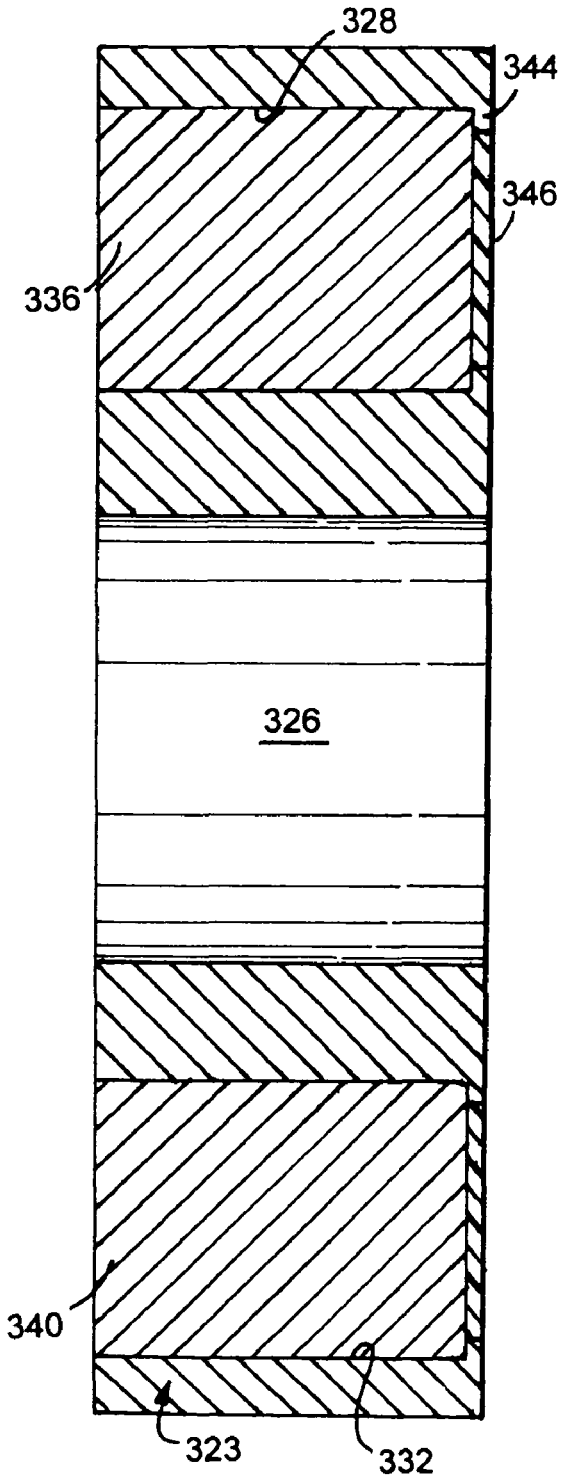
FIG. 16 is a sectional view taken along the line 16-16 of FIG. 15.
Figure 17:
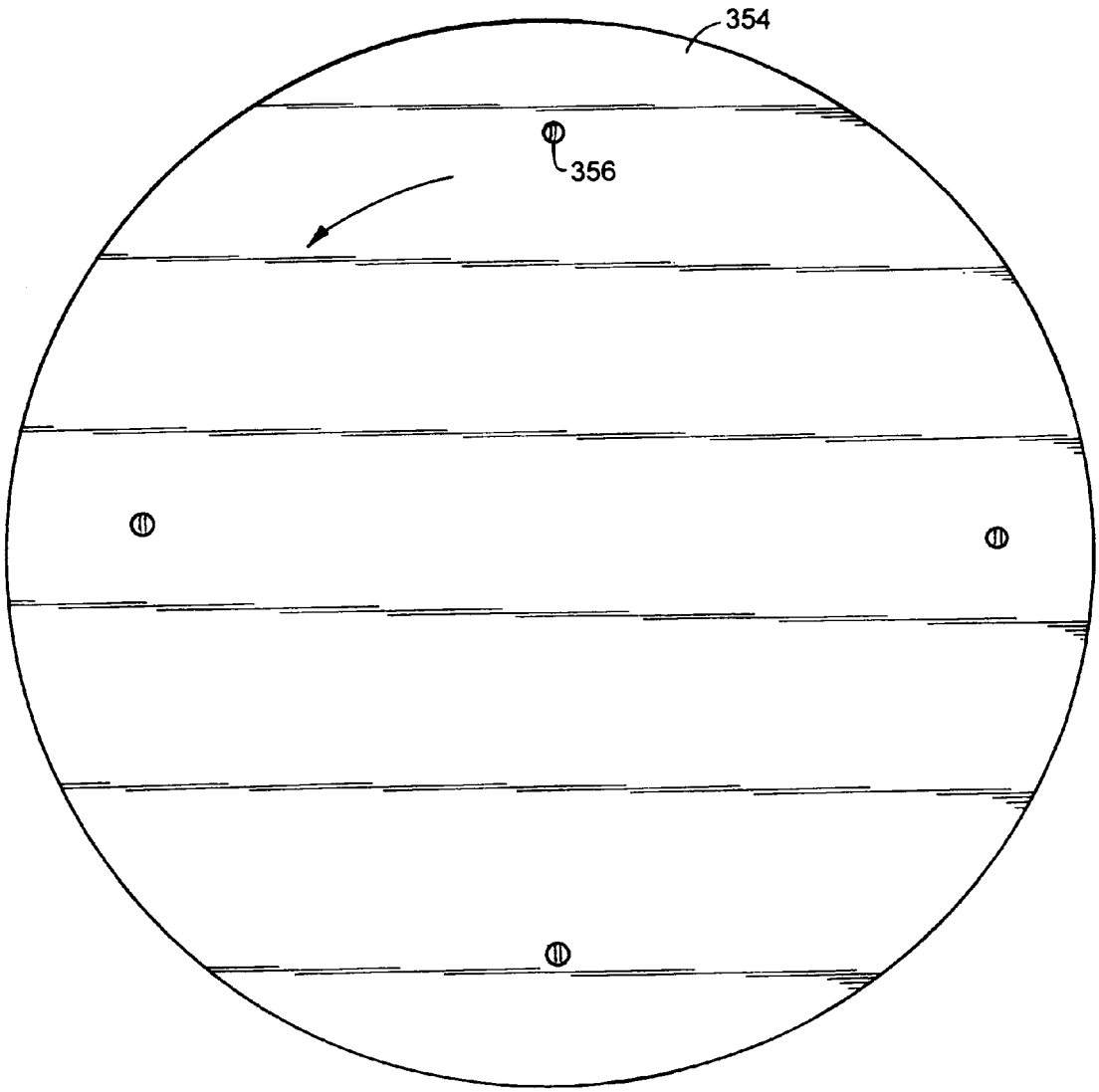
FIG. 17 is an enlarged sectional view taken along the line 17-17 of FIG. 14.

A primer mover 247 shown as an electric motor, is mounted on base 312 with supports 348. Supports 348 can be resilient mount members to reduce noise and vibrations. Motor drive shaft 349 supports a fan 351. The fan 351 has a hub 352 secured to shaft 349. A steel or ferrous metal disk 353 is secured to the outer end of shaft 349 adjacent fan 352. As shown in FIGS. 14 and 17, a copper absorber plate 354 is attached with fasteners 356 to steel disk 353. Copper plate 354 is located in flat surface engagement with the adjacent flat surface of steel desk 353. A non-ferrous or aluminum plate 317 secured with fasteners 318 to base 312 extends upward into chamber 311. Plate 317 has an opening 319. A sleeve 322 spaces plate 317 from screen 316 and directs air flow shown by arrow 361 to screen 316. An aluminum annular member or body 323 is secured to plate 317 with fasteners 324. Body 323 has a central opening 326 aligned with opening 319 to allow air to flow through chamber 311. Body 323, shown in FIG. 15, has a plurality of circular spaced cylindrical bores 327-335 accommodating cylindrical permanent magnets 336, 337, 338, 339, 340, 341, 342 and 343. The magnets 336-343 are cylindrical neodymium permanent magnets having uniform outer cylindrical walls located in surface engagement with the inside cylindrical walls of bores 328-335. Adjacent magnets have opposite polarities shown as N and S. The number, size and types of magnets mounted on body 323 can vary. As shown in FIG. 16, body 323 has circular lips or flanges 344 at the forward ends of bores 328-335 that function as stops to retain magnets 336-343 in bores 328-335. Coatings 346 located in the spaces surrounded by lips 344 protect the magnets 336-343. Body 323, plate 317 and coatings 346 protect magnets 336-343 from corrosion, breaking, cracking and fissuring.

In use, as shown in FIG. 14, motor 347 rotates fan 351 shown by arrow 358 and steel disk 353 and copper plate 354 relative to body 323 and magnets 336-343. Eddy currents in the gap or space 357 between copper plate 354 and magnets 336-343 generate heat that heats copper plate 354. The heat is transferred to air moving around copper plate 354. Hot air flows through opening 326, shown by arrow 361 to screen 316 and into the environment around heat generator 300.

There have been shown and described several embodiments of heat generators having permanent magnets. Changes in materials, structures, arrangement of structures and magnets can be made by persons skilled in the art without departing from the invention.

The invention claimed is:

1. An apparatus for heating air comprising:

a housing having an internal chamber, an air inlet opening and an air exit opening, a motor located within the internal chamber, a fan drivably connected to the motor operable to draw air into the air inlet opening, move air through the internal chamber and discharge air out of the air exit opening;

a ferrous metal member located in the internal chamber, a copper member secured to the ferrous metal member, a non-ferrous member located in the internal chamber adjacent the copper member, a plurality of permanent magnets mounted on the non-ferrous member, adjacent magnets having opposite north and south polarities, and a drive operable by the motor to rotate the ferrous metal member and copper member and the plurality of permanent magnets relative to each other to generate a magnet force field thereby heating air in the internal chamber, said heated air being moved through the internal chamber by the fan and discharged through the air exit opening.

2. The apparatus of claim 1 wherein:

the drive is a drive shaft rotated by the motor, said fan, ferrous metal member and copper member being mounted on the drive shaft whereby the motor rotates the fan, ferrous metal member and copper member, and at least one support connecting the non-ferrous member to the housing with said plurality of permanent magnets facing the copper member.

3. The apparatus of claim 2 wherein:

the non-ferrous member is an aluminum member.

4. The apparatus of claim 2 wherein:

the non-ferrous member has a plurality of cylindrical bores located in a spaced circular arrangement around the non-ferrous member, said plurality of permanent magnets comprising cylindrical magnets located in said cylindrical bores, and a non-ferrous plate secured to the non-ferrous member to retain the plurality of permanent magnets in the bores.

5. The apparatus of claim 4 wherein:

the cylindrical magnets are neodymium permanent magnets.

6. The apparatus of claim 1 wherein:

the non-ferrous member has a plurality of cylindrical bores located in a spaced circular arrangement around the non-ferrous member, said plurality of permanent magnets comprising cylindrical magnets located in said cylindrical bores, and a non-ferrous plate secured to the non-ferrous member to retain the plurality of permanent magnets in the bores.

7. The apparatus of claim 6 wherein:

the non-ferrous member is an aluminum member.

8. The apparatus of claim 6 wherein:

the cylindrical magnets are neodymium permanent magnets.

9. The apparatus of claim 6 wherein:

said non-ferrous member has circular lips at the ends of said bores, said lips providing stops to locate the cylindrical magnets in the cylindrical bores.

10. The apparatus of claim 6 wherein:

adjacent cylindrical magnets have opposite polarities.

11. The apparatus of claim 1 wherein:

the drive is a drive shaft rotated by the motor, said non-ferrous member being mounted on the drive shaft whereby the motor rotates the non-ferrous member and the plurality of permanent magnets mounted on the non-ferrous member, and at least one support connected to the ferrous metal member to secure the ferrous metal member to the housing with said copper member facing the permanent magnets.

12. The apparatus of claim 11 wherein:

the non-ferrous member is an aluminum member.

13. The apparatus of claim 11 wherein:

the non-ferrous member has a plurality of cylindrical bores located in a spaced circular arrangement around the non-ferrous member, said plurality of permanent magnets comprising cylindrical magnets located in said cylindrical bores, and a non-ferrous plate secured to the non-ferrous member to retain the magnets in the bores.

14. The apparatus of claim 13 wherein:

the cylindrical magnets are neodymium permanent magnets.

15. The apparatus of claim 13 wherein:

said non-ferrous member has circular lips at the ends of said bores, said lips providing stops to locate the plurality of cylindrical magnets in the cylindrical bores.

16. The apparatus of claim 13 wherein:

adjacent cylindrical magnets have opposite polarities.

* * * * *